US011360434B2

(12) United States Patent
Favre et al.

(10) Patent No.: US 11,360,434 B2
(45) Date of Patent: Jun. 14, 2022

(54) ACOUSTIC RADIATION MEMBRANE, AND STRIKING WATCH EQUIPPED WITH THE ACOUSTIC MEMBRANE

(71) Applicant: The Swatch Group Research and Development Ltd, Marin (CH)

(72) Inventors: Jerome Favre, Neuchatel (CH); Maude Spaetti, Neuchatel (CH); Gilles Duvoisin, Colombier (CH); Agnes Marlot Doerr, Neuchatel (CH)

(73) Assignee: The Swatch Group Research and Development Ltd, Marin (CH)

( * ) Notice: Subject to any disclaimer, the term of this patent is extended or adjusted under 35 U.S.C. 154(b) by 654 days.

(21) Appl. No.: 16/130,000

(22) Filed: Sep. 13, 2018

(65) Prior Publication Data

US 2019/0079456 A1 Mar. 14, 2019

(30) Foreign Application Priority Data

Sep. 14, 2017 (EP) ..... 17191103

(51) Int. Cl.
*G04B 21/08* (2006.01)
*G04B 23/02* (2006.01)
(Continued)

(52) U.S. Cl.
CPC ..... *G04B 21/08* (2013.01); *A44C 5/0007* (2013.01); *A44C 5/14* (2013.01); *A45C 13/008* (2013.01);
(Continued)

(58) Field of Classification Search
CPC .. G04B 21/08; G04B 23/028; G04B 37/0075; G04B 21/02; G04B 21/06; A44C 5/0007;
(Continued)

(56) References Cited

U.S. PATENT DOCUMENTS 1,503,570 A 8/1924 Weihenmeyer
8,369,188 B2 * 2/2013 Karapatis ..... G04B 23/028 368/243
(Continued)

FOREIGN PATENT DOCUMENTS

BE 414 646 4/1936
CN 101137251 A 3/2008
(Continued)

OTHER PUBLICATIONS

Combined Chinese Office Action and Search Report dated Oct. 19, 2020 in Chinese Patent Application No. 201811062060.0 (with English translation), 12 pages.
(Continued)

*Primary Examiner* — Edwin A. Leon
(74) *Attorney, Agent, or Firm* — Oblon, McClelland, Maier & Neustadt, L.L.P.

(57) ABSTRACT

The striking or musical watch includes a watch case having a case middle and a back attached to the case middle in a sealed manner and in a detachable manner, a glass closing the case in a sealed manner, a watch movement or a watch electronic module retained in the interior of the watch case and equipped with a sonic vibration generator to be activated during specific periods in order to produce a sound or music. The watch includes at least one acoustic radiation membrane made at least in part of wood or a wood composite material and attached to a part of the case in order to radiate the sound produced by the sonic vibration generator towards the exterior of the case.

27 Claims, 3 Drawing Sheets

(51) Int. Cl.

| | |
|---|---|
| ***A45C 13/00*** | (2006.01) |
| ***A44C 5/00*** | (2006.01) |
| ***G04B 37/00*** | (2006.01) |
| ***A44C 5/14*** | (2006.01) |
| ***G10K 13/00*** | (2006.01) |

(52) U.S. Cl.
CPC ..... *G04B 23/028* (2013.01); *G04B 37/0075* (2013.01); *G10K 13/00* (2013.01)

(58) Field of Classification Search
CPC ..... A44C 5/14; A45C 13/008; G10K 13/00; G10K 9/20; G04G 17/02
USPC ..... 368/75
See application file for complete search history.

(56) References Cited

U.S. PATENT DOCUMENTS

| | | | | |
|---|---|---|---|---|
| 8,665,676 | B2 * | 3/2014 | Sarchi | G04B 37/0075 368/272 |
| 9,164,487 | B1 * | 10/2015 | Raggi | G04B 21/02 |
| 9,519,271 | B2 * | 12/2016 | Karapatis | G10K 1/10 |
| D798,744 | S | 10/2017 | Wright et al. | |
| 10,777,170 | B2 * | 9/2020 | Ognibeni | H04R 7/04 |
| 2012/0140602 | A1 | 6/2012 | Favre et al. | |
| 2017/0035156 | A1 | 2/2017 | Wright et al. | |
| 2017/0347764 | A1 | 12/2017 | Wright et al. | |

FOREIGN PATENT DOCUMENTS

| | | | |
|---|---|---|---|
| CN | 101282593 | A | 10/2008 |
| CN | 105093903 | A | 11/2015 |
| CN | 105527819 | A | 4/2016 |
| EP | 2 461 220 | A1 | 6/2012 |
| EP | 2 942 675 | A1 | 11/2015 |
| FR | 825.885 | A | 3/1938 |
| JP | 2001-242855 | | 9/2001 |
| JP | 3429170 | B2 | 7/2003 |
| WO | WO 2017/024104 | A1 | 2/2017 |

OTHER PUBLICATIONS

European Search Report dated Mar. 19, 2018 in European Application 17191103.5, filed on Sep. 14, 2017 ( with English Translation of Categories of Cited Documents).

Anonymous "Materiau composite", http://web.archive.org/web/20161215054 4O6/httpd://fr.wikipedia.org/wiki/mat%C3%A9riaUcomposite, 5 pages.

Chinese Office Action dated Apr. 7, 2021 in Chinese Patent Application No. 201811062060.0 (with English translation), 12 pages.

* cited by examiner

ACOUSTIC RADIATION MEMBRANE, AND STRIKING WATCH EQUIPPED WITH THE ACOUSTIC MEMBRANE

This application claims priority from European patent application No. 17191103.5 filed on Sep. 14, 2017, the entire disclosure of which is hereby incorporated herein by reference.

TECHNICAL FIELD OF THE INVENTION

The invention relates to an acoustic radiation membrane for a striking or musical watch.

The invention also relates to a striking or musical watch comprising at least one acoustic radiation membrane. The watch comprises a watch case having essentially a case middle and a back attached to the case middle in a sealed manner and in a detachable manner. A glass is disposed on an opposite side of the case middle in order to close said case in a sealed manner. A watch movement or a watch electronic module are retained in a sealed manner in the watch case. With the watch movement, a striking mechanism is capable of being activated during specific periods in order to produce a sound or music. At least one acoustic membrane is attached to the case in order to radiate the sound produced by the striking mechanism or the watch electronic module towards the exterior of the case.

STATE OF THE ART

In the field of watchmaking, a traditional architecture is utilized to produce movements, which may also comprise striking mechanisms. A suchlike striking mechanism may be activated during very specific periods in order to indicate a scheduled alarm or minute repeaters, for example, for the conventional implementation of a striking watch, the striking mechanism may comprise at least one gong. This gong is generally a metallic wire of circular form, which may surround a part of the watch movement inside a watch frame. This gong is attached to a gong-carrier that is normally integral with a watch plate. The vibration of the gong is produced by the impact of at least one hammer or equivalent against the gong during specific periods.

In the case of a musical watch, the sound is produced by the vibrations of tongues of a pin-barrel of the striking mechanism.

In order to be able to radiate the sound generated inside the watch case by the striking mechanism or the musical mechanism effectively towards the exterior, a membrane of the acoustic type may be utilized in addition for the vibro-acoustic transduction. This acoustic membrane is attached in a sealed manner preferably between the back and the case middle of the watch case, in particular by being sandwiched between a part of the case middle and the back of the watch case. The back may further comprise one or a plurality of apertures for the transmission of the sound of the vibrating membrane towards the exterior of the watch case.

The acoustic membrane is usually made of steel, or amorphous metal or metallic glass, or polymer, or some other metallic material. This type of material is also selected for reasons of its resistance to environmental stresses, such as moisture or water. With these types of acoustic membranes inside a watch case, the acoustic radiation of the vibrating membrane is not generally sufficient, which constitutes a disadvantage.

A striking or chiming clock is known from patent BE 414646 A. The striking mechanism or the chiming mechanism is disposed in a casing made of wood attached to a casing made of marble. A face of the casing made of wood is free to resonate following the generation of a sound by the striking mechanism or the chiming mechanism. However, a suchlike arrangement is of large dimensions and may not equip a striking or musical watch of the wristwatch type, which constitutes a disadvantage.

SUMMARY OF THE INVENTION

The aim of the invention is thus to address the disadvantages of the prior art by providing a striking or musical watch, which is equipped with an acoustic radiation membrane, in order to obtain a good acoustical performance during the operation of a striking mechanism inside the watch case.

For this purpose, the invention relates to an acoustic radiation membrane for a striking or musical watch, and intended to be mounted in a case of the striking or musical watch, wherein at least one part of the acoustic membrane is made of wood or a wood composite material.

Particular embodiments of the acoustic radiation membrane are defined in dependent claims 2 to 14.

One advantage of the acoustic radiation membrane according to the present invention resides in the fact that this acoustic membrane inside the watch case is made at least in part of wood or a composite material, such as a wood composite, preferably solid wood or a precious or noble wood, such as mahogany. A protective layer or a lacquer may be deposited on the wooden membrane or may impregnate said membrane in order to protect it from environmental conditions, such as moisture or water.

In the field of musical instruments, wood is the material that has been favoured for centuries for its acoustic properties, in particular its capacity to radiate vibrations of a large part of the audio spectrum in the air. However, the use of a structure or a membrane made of wood has never been considered in the design of a top-of-the-range striking or musical watch in order to radiate effectively the sound generated inside the watch case by the striking work.

For this purpose, the invention also relates to a striking or musical watch comprising a watch case, which comprises a case middle and a back attached in a sealed manner and in a detachable manner to the case middle, a glass closing the case in a sealed manner, a watch movement or a watch electronic module retained in the interior of the watch case and equipped with a sonic vibration generator intended to be activated during specific periods in order to produce a sound or music, and at least one acoustic radiation membrane according to a striking or musical watch and intended to be mounted in a case of the striking or musical watch, wherein at least one part of the acoustic membrane is made of wood or a wood composite material.

Embodiments of the striking or musical watch are defined in dependent claims 16 to 27.

The acoustic membrane may be mounted advantageously inside the watch case as a double back, and one or more lateral apertures may be provided in the back giving access to the membrane for the good transmission of the sound of the vibrating membrane towards the exterior of the watch case. This membrane may be mounted by adhesive bonding on an interior surface of the case middle of the watch case or may be crimped between metallic parts of the case, for example.

Advantageously, the acoustic membrane may be mounted at the level of the watch dial in replacement thereof or above or below the traditional dial. It may be attached to the bezel securing the watch glass, and one or more lateral apertures in the bezel may be provided giving access to the membrane for the good transmission of the sound of the vibrating membrane towards the exterior of the watch case.

Advantageously, the acoustic membrane may be mounted in combination with a part of the dial and preferably in the same plane. The membrane may be in the form of a half-moon, whereas the part of the dial is in the form of a half-moon having a complementary shape to the membrane in order to form in combination a circular dial. Consideration may also be given to having a dial of rectangular form with the membrane constituting a rectangular part connected to the other part of the dial.

Advantageously, a plurality of acoustic membranes made of wood or a wood composite may be provided inside the watch case. A first membrane may be provided at the level of the dial, and a second membrane may be provided as a double back above of the back of the watch case. Provision may also be made for a plurality of acoustic membranes to be mounted spaced apart one from the other or superposed.

BRIEF DESCRIPTION OF THE FIGURES

The aims, advantages and characterizing features of the acoustic radiation membrane and of the striking or musical watch containing it will be more readily appreciated in the following description on the basis of the non-exhaustive embodiments illustrated by the drawings, in which.

DETAILED DESCRIPTION OF THE INVENTION

All the parts of the striking or musical watch, which comprises at least one acoustic membrane, and which are familiar to a person skilled in the art in this technical field, are described only in a simplified manner in the following description.

Figure 1:
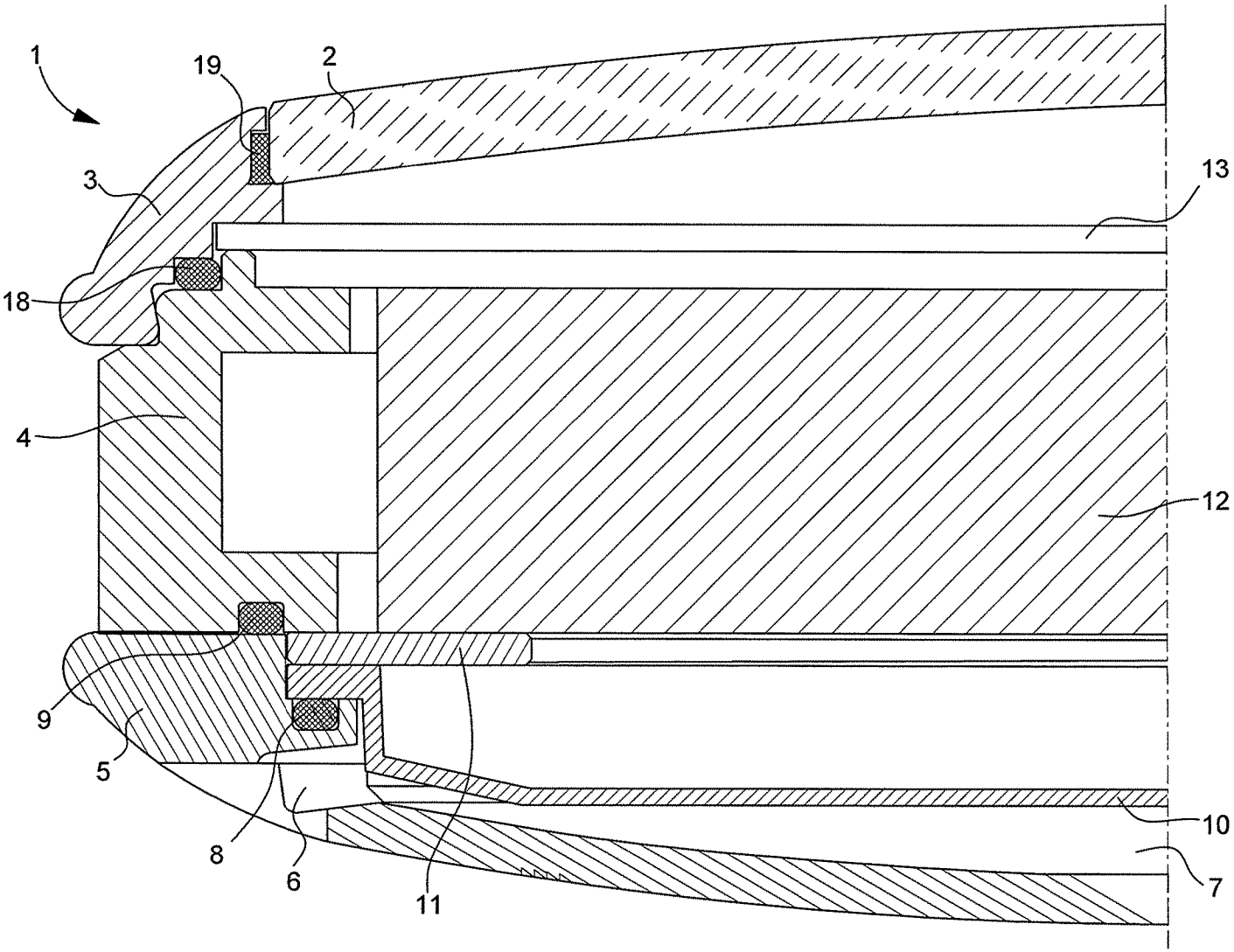
FIG. 1 depicts in a simplified manner a partial section of a first embodiment of a striking or musical watch equipped with an acoustic membrane according to the invention.

FIG. 1 depicts a simplified partial section of a first embodiment of a striking or musical watch 1 having an acoustic membrane 10. The watch comprises essentially a watch case, which is composed of a case middle 4, to which a bezel 3 is attached in a sealed manner with a sealing gasket 18 on one side and a back 5 attached on the other side of the case middle 4. The back 5 is mounted on the case middle 4 by known means and in a detachable manner with a sealing gasket 9. A watch glass 2 is attached to the bezel 3, in particular by a joint 19, in order to close the watch case in a sealed manner. A dial 13 is retained at its edge on the case middle 4 and is disposed below the watch glass 2. In the case of a mechanical striking or musical watch 1, hands for indicating the hour, which are not depicted here, are provided on the dial 13, which generally carries hour indices around its periphery.

The striking or musical watch 1 also comprises a watch movement 12 or a watch electronic module, which are normally mounted on a plate. An edge part is attached to the plate, which defines a watch frame. Both the plate and the edge part are usually made of a metallic material, which is customary in a mechanical watch of the top-of-the-range type.

The watch movement 12 or the watch electronic module comprises a sonic vibration generator for the generation of a sound or of music during predefined periods of time. In the case of a watch movement 12, the sonic vibration generator is a striking mechanism, which is not depicted here. This striking mechanism may comprise at least one gong mounted on a gong-carrier attached to the plate, and at least one hammer mounted rotatably on the plate in order to strike said gong during specific periods. The gong, which is generally of circular form, may surround certain parts of the watch movement. A suchlike striking mechanism is provided in order to indicate a scheduled alarm or minute repeaters, for example.

In an improved embodiment of a musical watch, the striking mechanism may comprise a pin-barrel having a set of tongues attached to a heel, which is attached to the plate. The sound or the succession of musical notes is produced by the vibrations of tongues of the pin-barrel. Each tongue is configured for the production of a particular note. In order to produce music, for example during scheduled periods, the tongues of the pin-barrel are raised and then released by means of pins that are integral with a cylinder or with a rotating disc on the plate. Each activated tongue oscillates principally at its first natural frequency. The vibrations generated by the activated tongues are transmitted to the external parts of the watch, which must permit the sound produced by each vibrating tongue to be radiated acoustically.

In the case of an electronic striking or musical watch 1, the sonic vibration generator of the watch electronic module generates at least one sound or music, which may be memorized in a dedicated memory. The sonic vibration generator may, in a traditional manner, comprise a piezoelectric element or a loudspeaker in order to diffuse a sound or music during predefined periods of time.

The striking or musical mechanical or electronic watch 1 comprises essentially at least one acoustic membrane 10 in order to improve the acoustic performance of the sound produced by the sonic vibration generator, such as the striking mechanism. For the purposes of this present invention, the acoustic membrane 10 is made advantageously of wood or a composite material, which may be a wood composite, for example, without any limitation. The thickness of the membrane may be in the order of 1 mm.

It should be noted that the expression composite material is generally used to denote a material which is constituted by a frame construction or base referred to as a reinforcement, which may generally comprise fibres which ensure the mechanical stability, and by a binding agent referred to as a matrix. This binding agent is more often than not a plastic material, such as a thermoplastic resin or thermosetting resin, which ensures the cohesion of the structure and the transmission of the forces towards the reinforcement. In the case of the present invention, the composite material may also comprise a matrix of one or a plurality of polymers, into which one or a plurality of natural or synthetic fibres and/or particles of any type are introduced. This may also be a matrix made of wood, into which a resin and/or particles of any type is introduced.

The material of the acoustic membrane 10 may also be made of a precious or noble wood, such as mahogany or oak or birch, which is known for its excellent acoustic radiation properties. It may also be selected from among spruce or maple or rosewood or violetwood or cherry or ebony that are generally used in the design of violins or guitars. It may also be selected from among other woods, such as poplar, willow, walnut, fir and even certain fruit trees.

Wood is a material that is relatively sensitive to moisture, in particular its geometrical properties. Typically, an elongation of 2 to 10% may be observed when a dry wood is immersed in water. This undesirable effect may be acceptable in a watch of which the design is appropriately adapted, although ideally this effect must be minimized, for example with a treatment by infiltration or with surface layers.

The acoustic membrane, once it has been produced, may thus be additionally stained with a colour, coated with a protective layer or a protective lacquer or impregnated with a protective substance in order to protect the membrane from environmental conditions, such as moisture or water. Nanocellulose is a new material which may be utilized to reinforce the mechanical properties of the wooden membrane, and to improve the dimensional consistency in variable environments (T and RH), or even to prevent the absorption of moisture.

A plurality of species of wood, of which the acoustic properties are complementary, may also be utilized in the same radiation membrane in order to produce a suchlike membrane in wood. A lightweight and very nervous wood having a dense homogeneous wood may be utilized. Bonding techniques exist and may be applied in this particular case. These combinations may take the form of reinforcements or reduced thicknesses of different geometries, for example straight or concentric, in the same membrane. The wood that is used may also be densified in order to improve the acoustic radiation properties according to a technique of the Higher Technical School of Wood in Bienne in Switzerland.

A membrane having an assembly or adhesive bonding of a plurality of layers one on top of the other may be produced, for example with different species of wood. It may be proposed that at least one of the layers is constituted by natural or synthetic fibres disposed according to a well-defined orientation. Apertures which are inspired by the rosettes and the sound holes of stringed instruments may also be produced in the membrane, although in this case a protective membrane must also be provided in the interior of the watch case in order to protect the watch movement or the watch electronic module.

In the case of at least one layer of natural or synthetic fibres, the orientation of the fibres in the membrane may be dependent on the location of the membrane inside the watch case and according to the disposition of the gong-carrier or of the base of a pin-barrel for a mechanical striking mechanism. The one or more superposed layers may comprise wooden fibres or also carbon fibres.

By way of comparison, tests have been conducted on a membrane made of mahogany, which have been compared to a traditional construction. These tests have revealed that a membrane made of mahogany permits an improvement in the acoustic radiation of between 4 and 5 dBA in relation to a traditional design, which is significant for the user at a distance of 30 cm from the vibrating membrane. The resonance thereof is also increased.

It should be further noted that the tonal balance is also improved. All the frequencies created by the struck gong, in particular the low frequencies below 7 kHz, are radiated at a substantially equivalent level, whereas a traditional solution based on membranes made of metal or ceramic tends to select a mode of the gong, for example acute, at around 6.8 kHz, and to radiate the other modes only a little. The result is a sound radiated with greater richness and balance when the wooden membrane, in particular made of mahogany, is utilized. This has also been confirmed by psycho acoustic studies.

It can also be noted that the membrane made of mahogany improves both the radiation of low frequencies, which contributes to the "strength" of the sound, as well as the high-frequency driver, which improves its "brilliance".

In the first embodiment depicted in FIG. 1, the acoustic membrane 10 has a dished shape, of which the upper edge is mounted in a sealed manner by an annular sealing gasket 8 on an interior annular rim of the back 5 of the case. The diameter of this dish, which may be equivalent to the diameter of the watch glass 2, may be in the range between 20 and 40 mm. A support 11 of annular form supports the plate with the edge part on one side and rests on the upper edge of the acoustic membrane 10. At the moment of the attachment of the case middle 4 to the back 5 of the watch case, the support 11 and the peripheral edge of the acoustic membrane 10 are crimped, or adhesive-bonded, between the case middle 4 and the rim of the back 5.

The central part of the acoustic membrane is not in contact with the support 11 and the interior surface of the back 5. Because of this, a sufficient space 7 is provided inside the case for the acoustic membrane to be able to vibrate freely or to radiate acoustically. The assembly of the acoustic membrane 10 and of the back 5 thus constitutes a double back. One or a plurality of lateral apertures 6 are also provided laterally across the back 5 in order to permit the acoustic membrane 10 to radiate the sound produced by the striking mechanism towards the exterior.

During operation of the striking mechanism, the sound produced by said striking mechanism is transmitted directly to the acoustic membrane 10 in order to cause it to vibrate. The transmission of vibration to the acoustic membrane 10 is also provided at the edge of the acoustic membrane by the connecting parts, such as the annular support 11. Since the acoustic membrane 10 is made of wood or a composite material, it is able to radiate the sound generated by the striking mechanism more intensely towards the exterior in comparison with a traditional acoustic membrane made of metal or amorphous metal or ceramic, for example.

Figure 2:
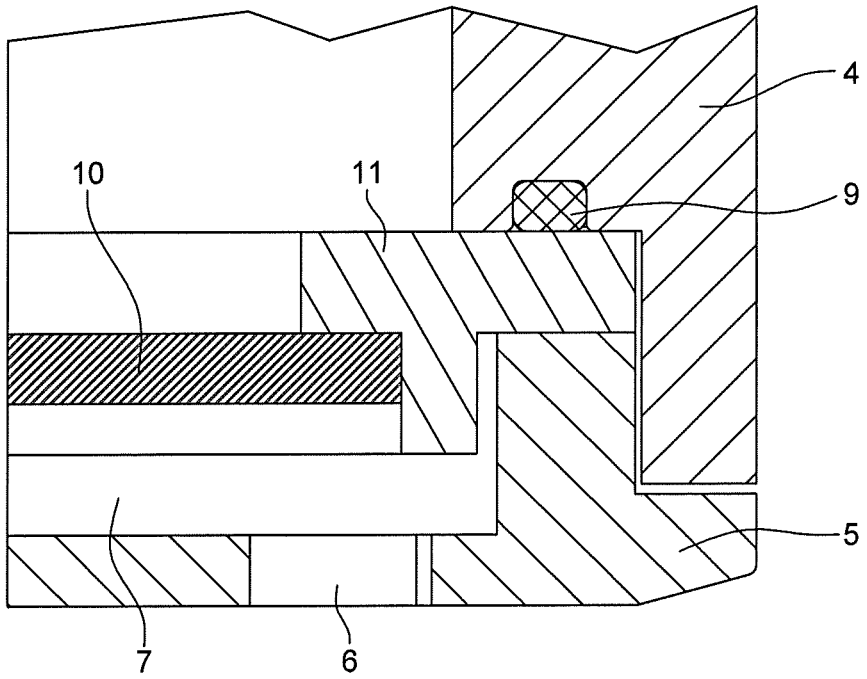
FIG. 2 depicts in a simplified manner a partial section of a variant of the first embodiment of a striking or musical watch equipped with an acoustic membrane according to the invention.

FIG. 2 depicts a variant of the first embodiment described above in relation to FIG. 1. In this variant embodiment, the acoustic membrane 10 made of wood or a composite material, such as a wood composite, is of a plane circular form, for example. This acoustic membrane 10 is attached to a support 11 comprising an interior edge in the form of a corner for the attachment of the acoustic membrane, in particular by adhesive bonding. This support 11 may be produced in a metallic material.

A peripheral edge of the support 11 is retained by crimping by means of a sealing gasket 9 between the case middle 4 and the back 5 attached to the case middle 4. One or a plurality of apertures 6 are produced in the back 5, and a sufficient space 7 is left inside the watch case between the acoustic membrane 10 and the interior surface of the back.

Figure 3:
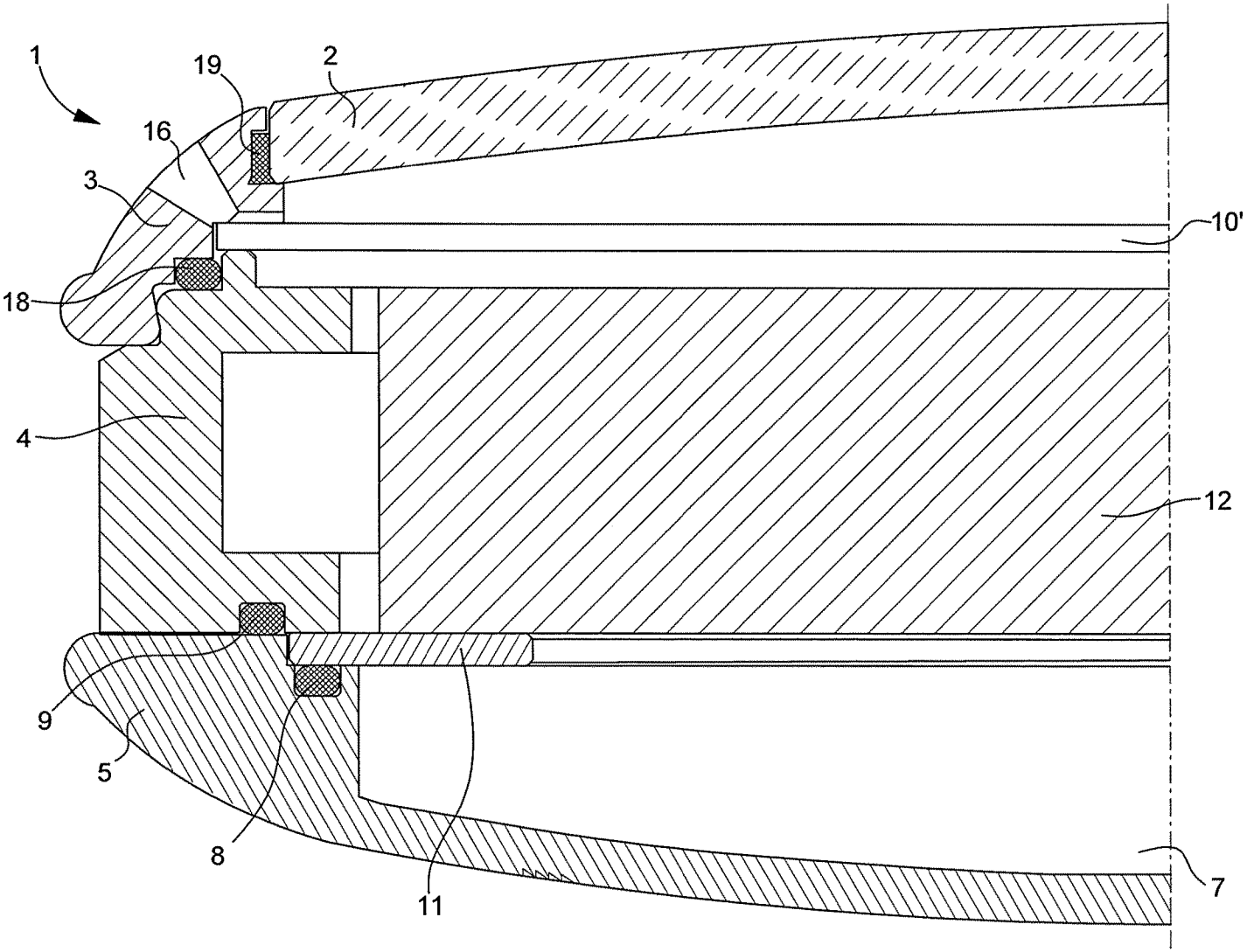
FIG. 3 depicts in a simplified manner a partial section of a second embodiment of a striking or musical watch equipped with an acoustic membrane according to the invention.

FIG. 3 depicts a simplified partial section of a second embodiment of a striking watch 1 having an acoustic membrane 10'. This second embodiment differs from the first embodiment in that the acoustic membrane 10' is disposed as a watch dial beneath the glass 2 attached by a joint 19, for example to a bezel 3. The membrane in this case is in the form of a plane disc. The bezel may also be mounted in a sealed manner with a sealing gasket 18 on the case middle 4. The acoustic membrane 10' may thus replace the traditional dial of a suchlike watch, but may also be disposed below or preferably above a traditional dial.

In this second embodiment, one or a plurality of lateral apertures 16 may be provided in the bezel, furthermore, giving access to the acoustic membrane 10'. These lateral apertures 16 are provided for the transmission of the sound of the vibrating membrane towards the exterior of the watch case. On the other hand, the back 5 of the watch case no longer contains any apertures, given that the acoustic membrane 10' is disposed only at the level of the dial. The back 5 is mounted by known means and in a detachable manner on the case middle 4 with a sealing gasket 9, and another sealing gasket 8 may also be provided in order to maintain the annular support 11 supporting the watch movement 12 with the striking work.

It should be noted that consideration may also be given to having a combination of the two above-mentioned embodiments with an acoustic membrane 10 in a double back and another acoustic membrane 10' at the level of the dial. In the case depicted in the figure, it is necessary to have lateral apertures 6, 16 at the level of the back 5 and across the bezel 3 for the transmission of the sound towards the exterior of the watch case.

Figure 4:
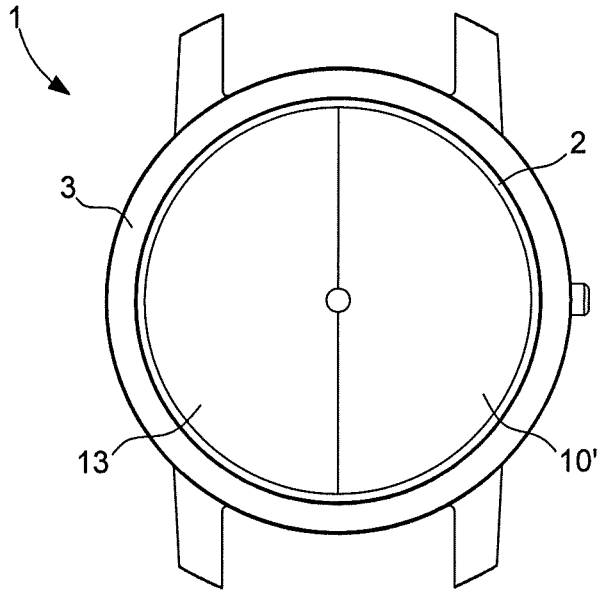
FIG. 4 depicts in a simplified manner a partial view from above of a third embodiment of a striking or musical watch equipped with an acoustic membrane according to the invention.

Represented in FIG. 4 is a third embodiment of the striking watch 1 having an acoustic membrane 10'. This third embodiment is similar to the second embodiment, with the sole difference that the acoustic membrane 10' in the form of a half-moon is attached in the same plane to a half-moon of a part of the dial 13. The acoustic membrane 10' and the part of the dial 13 constitute the whole of the dial visible beneath the glass 2 attached to the bezel 3. The watch hands are not depicted for the sake of simplicity, as well as the one or more lateral apertures on the bezel. This acoustic membrane may be produced or mounted in a part of the dial 13.

It is also possible to consider the incorporation of a portion of membrane in the watch glass, even if this embodiment is more complicated than those described above.

The acoustic membrane may be produced with a complex, non-uniform thickness or with a form other than circular. It may be of conical or undulating form from the centre towards the exterior, or it may contain grooves. The acoustic membrane may further comprise a layer of wood in association with a layer of carbon or polymer (resin) as a composite material. These two layers may be associated by adhesive bonding or some other forming process. It may also be coated or impregnated with at least one protective layer, which comprises an inorganic layer, such as a metallic layer or an oxide layer.

The membrane can be made of a wood composite comprising a polymeric matrix, into which fibres and/or particles of wood are introduced. The particles of wood can be associated with organic particles, such as natural vegetable fibres or inorganic particles, such as particles of graphene or carbon nanotubes. The membrane can further be an assembly or adhesive bonding of a plurality of layers one on top of the other having a relative orientation of the different fibres between each successive layer. The membrane can further be an assembly or adhesive bonding of a plurality of layers one on top of the other, wherein at least one of the layers is made of wood and is associated with other layers made of graphene or natural fibres or glass fibres.

Based on the above description, a plurality of variant embodiments of the acoustic radiation membrane and of the striking or musical watch containing it may be conceived by a person skilled in the art without going beyond the scope of the invention defined by the claims. This wooden acoustic membrane may also be situated in the watch case at the level of the case middle with an aperture through the case middle for the sound radiation of the vibrating acoustic membrane. A plurality of acoustic membranes disposed in a plurality of locations in the interior of the watch case or superposed may be proposed. It may also be proposed for the acoustic membrane to be produced with a taut skin attached to a frame in order to radiate the sound generated by the sonic vibration generator.

What is claimed is:

1. An acoustic radiation membrane for a striking or musical watch and configured to be mounted in a case of the striking or musical watch, wherein the acoustic radiation membrane is configured to be attached to a support of the case, the support being positioned between a case middle and a case back, wherein the support includes an interior edge in the form of a corner for the attachment of the acoustic membrane thereto such that each of a top surface and a side surface of the acoustic radiation membrane is in contact with the support, and the support includes an exterior edge in the form of a periphery of the support, the periphery of the support being crimped between the case middle and an interior rim of the back of the case, and wherein at least one part of the acoustic membrane is made of wood or a wood composite material.

2. The acoustic radiation membrane according to claim 1, wherein the membrane is made of solid wood, the solid wood being one of mahogany, oak or birch.

3. The acoustic radiation membrane according to claim 1, wherein the membrane is made of a wood composite comprising a plurality of species of wood bonded together.

4. The acoustic radiation membrane according to claim 3, wherein the membrane is made of lightweight and very nervous wood using a homogeneous densified wood.

5. The acoustic radiation membrane according to claim 1, wherein the membrane is made of a wood composite comprising a polymeric matrix, into which fibres and/or particles of wood are introduced.

6. The acoustic radiation membrane according to claim 5, wherein the particles of wood are associated with organic particles, the organic particles being one of natural vegetable fibres or inorganic particles, the inorganic particles being graphene or carbon nanotubes.

7. The acoustic radiation membrane according to claim 1, wherein the membrane is an assembly or adhesive bonding of a plurality of layers one on top of the other, and wherein the layers comprise different species of wood.

8. The acoustic radiation membrane according to claim 1, wherein the membrane is an assembly or adhesive bonding of a plurality of layers one on top of the other having a relative orientation of the different fibres between each successive layer.

9. The acoustic radiation membrane according to claim 1, wherein the membrane is an assembly or adhesive bonding of a plurality of layers one on top of the other, and wherein at least one of the layers is made of wood and is associated with other layers made of graphene or natural fibres or glass fibres.

10. The acoustic radiation membrane according to claim 1, wherein a protective layer or a protective lacquer is deposited on the acoustic membrane in order to protect it from environmental conditions.

11. The acoustic radiation membrane according to claim 1, wherein the acoustic membrane is impregnated with a protective substance in order to protect it from environmental conditions.

12. The acoustic radiation membrane according to claim 1, wherein the acoustic membrane is impregnated with nano-cellulose in order to reinforce its mechanical properties.

13. The acoustic radiation membrane according to claim 1, wherein the acoustic membrane is stained with a colour.

14. The acoustic radiation membrane according to claim 1, wherein the acoustic membrane is coated or impregnated with at least one protective layer, which comprises an inorganic layer, the inorganic layer being one of a metallic layer or an oxide layer.

15. A striking or musical watch comprising:

a watch case, the watch case having a case middle and a back attached in a sealed manner and in a detachable manner to the case middle;

a glass closing the case in a sealed manner;

a watch movement or a watch electronic module retained in the interior of the watch case and equipped with a sonic vibration generator configured to be activated during specific periods in order to produce a sound or music;

at least one acoustic radiation membrane, which is made at least in part of wood or a wood composite material, and is attached to a part of the case in order to radiate the sound produced by the sonic vibration generator towards the exterior of the case; and a support positioned between the middle and the back, the support including an interior edge in a form of a corner, and an exterior edge in the form of a periphery of the support, wherein a periphery of the acoustic radiation membrane is attached to the interior edge such that each of a top surface and a side surface of the acoustic radiation membrane is in contact with the interior edge, and wherein the periphery of the support is crimped between the case middle and an interior rim of the back of the case.

16. The striking or musical watch according to claim 15, wherein the sonic vibration generator is a striking mechanism equipped with at least one gong configured to be struck by at least one hammer, or with at least one pin-barrel having a set of tongues, which may be raised and then released by pins that are integral with a cylinder or with a rotating disc.

17. The striking or musical watch according to claim 15, wherein the acoustic membrane is disposed in the interior of the watch case between the back of the case and the watch movement or the watch electronic module with the sonic vibration generator constituting a double back thereof.

18. The striking or musical watch according to claim 17, wherein the acoustic membrane is retained on an interior rim of the back of the case and a part of the case middle.

19. The striking or musical watch according to claim 18, wherein the watch movement or the watch electronic module is disposed on an annular support.

20. The striking or musical watch according to claim 19, wherein the acoustic membrane has a dished shape, an annular sealing gasket being positioned between the rim of the back and the annular edge of the membrane, and wherein a central part of the acoustic membrane is not in contact with the support and an interior surface of the back of the case in order to define a space so as to be able to oscillate freely.

21. The striking or musical watch according to claim 17, wherein the acoustic membrane is of plane circular form and is attached to the support by adhesive bonding, and wherein a peripheral edge of the support is retained by crimping by means of a sealing gasket between the case middle and the back.

22. The striking or musical watch according to claim 17, wherein the back of the case comprises at least one aperture in the side or in the back in order to permit the vibrating acoustic membrane to produce sound radiation towards the exterior of the watch case.

23. The striking or musical watch according to claim 17, wherein a plurality of acoustic membranes are attached to the watch case and are spaced apart one from the other or are superposed.

24. The striking or musical watch according to claim 15, wherein the glass is attached to a bezel of the watch case, which is mounted in a sealed manner on the case middle of the watch case, and wherein the acoustic membrane is mounted in the form of a watch dial or above or below a traditional watch dial.

25. The striking or musical watch according to claim 15, wherein the glass is attached to a bezel of the watch case, which is mounted in a sealed manner on the case middle of the watch case, and wherein the acoustic membrane is produced or mounted in a part of the watch dial.

26. The striking or musical watch according to claim 25, wherein the acoustic membrane is in the form of a half-moon attached to a part of the dial in the form of a half-moon.

27. The striking or musical watch according to claim 24, wherein the bezel comprises at least one lateral aperture in order to permit the vibrating acoustic membrane to produce sound radiation towards the exterior of the watch case.

* * * * *